US012533567B2

(12) United States Patent
Drendel et al.

(10) Patent No.: US 12,533,567 B2
(45) Date of Patent: Jan. 27, 2026

(54) PROTECTIVE CUP

(71) Applicants: Drake Drendel, Glendora, CA (US); Ryan Nicholas Rodriguez, San Dimas, CA (US)

(72) Inventors: Drake Drendel, Glendora, CA (US); Ryan Nicholas Rodriguez, San Dimas, CA (US)

( * ) Notice: Subject to any disclaimer, the term of this patent is extended or adjusted under 35 U.S.C. 154(b) by 0 days.

(21) Appl. No.: 19/096,713

(22) Filed: Apr. 1, 2025

(65) Prior Publication Data

US 2025/0360391 A1 Nov. 27, 2025

Related U.S. Application Data

(60) Provisional application No. 63/651,911, filed on May 24, 2024.

(51) Int. Cl.
*A63B 71/12* (2006.01)

(52) U.S. Cl.
CPC ..... *A63B 71/1216* (2013.01)

(58) Field of Classification Search
CPC ..... A63B 71/1216; A41D 13/0575; A41D 13/065
See application file for complete search history.

(56) References Cited

U.S. PATENT DOCUMENTS

| | | | | |
|---|---|---|---|---|
| 4,287,885 | A * | 9/1981 | Applegate | A61F 13/061 2/24 |
| 4,453,541 | A * | 6/1984 | Castelli | A61F 5/40 602/72 |
| 5,537,689 | A * | 7/1996 | Dancyger | A41D 13/0568 2/24 |
| 6,279,160 | B1 * | 8/2001 | Chen | A41D 13/065 2/24 |
| 7,237,270 | B2 * | 7/2007 | Crye | A41D 13/0575 2/24 |
| 7,376,978 | B2 * | 5/2008 | Godshaw | A41D 13/0568 2/24 |
| 8,752,217 | B1 * | 6/2014 | Cheney | A41D 13/0525 2/403 |
| 9,526,969 | B1 * | 12/2016 | Raber | A41D 13/05 |
| 2009/0171260 | A1 * | 7/2009 | Lerma | A63B 71/1216 602/72 |
| 2010/0223709 | A1 * | 9/2010 | Crye | A41D 13/0581 2/24 |
| 2020/0390165 | A1 * | 12/2020 | Sheu | A63B 71/1216 |

* cited by examiner

*Primary Examiner* — Tajash D Patel
(74) *Attorney, Agent, or Firm* — Crandall IP

(57) ABSTRACT

A protective cup apparatus includes a base frame including a curved and contoured shell shape with a perimeter edge, the base frame including a first material. The protective cup apparatus further includes a padded lip coupled to and around the perimeter edge of the base frame, wherein the padded lip includes a second material, and wherein the second material has a lower hardness than the first material. The protective cup apparatus includes at least one pad coupled to a front face of the base frame, wherein the pad is comprised of a viscoelastic material, and wherein the pad extends past an outermost front surface of the base frame.

20 Claims, 10 Drawing Sheets

PROTECTIVE CUP

RELATED APPLICATIONS

This application claims the benefit of U.S. Provisional Patent Application No. 63/651,911, filed May 24, 2024, which is incorporated herein by reference in its entirety.

BACKGROUND

This disclosure relates generally to a protective cup. More specifically, this disclosure relates generally to a protective cup apparatus for use in various physical activities where protection is required or wanted.

A cup (athletic supporter) is commonly worn in sports where there is a significant risk of impact to the groin area, providing crucial protection against injuries that can be both painful and debilitating. In high-contact sports like American football, ice hockey, rugby, and lacrosse, players frequently wear cups due to the physical nature of the game, where tackles, collisions, and stray equipment can pose a threat. In baseball and softball, players, especially catchers and infielders, are at risk of being struck by fast-moving balls, wild pitches, or sliding opponents, making a cup an essential piece of gear. Martial artists, including those in MMA, karate, taekwondo, and jiu-jitsu, often rely on groin protection, as strikes, knee attacks, and accidental blows can occur during training or competition. Similarly, boxers and wrestlers may wear cups to safeguard against unexpected punches or grappling maneuvers, though some wrestling organizations prohibit them due to concerns about discomfort or interference with movement. In cricket, wicketkeepers and batsmen wear protective cups to guard against potentially serious injuries Soccer goalkeepers and field hockey players may also choose to wear one for added safety. Additionally, those participating in paintball or airsoft sometimes wear a cup to protect against high-speed projectiles. While not required in every sport, a cup is an essential piece of protective gear in situations where groin injuries are a significant risk.

One of the biggest reasons athletes choose not to wear a cup is discomfort. While cups provide essential protection, many players find them restrictive, bulky, or irritating, which can affect their movement and overall performance. In sports that require a lot of running, agility, or flexibility (such as soccer, wrestling, and basketball) some athletes feel that a cup interferes with their ability to move freely. The rigid structure of traditional cups can cause chafing, pinching, or pressure against the body, making them uncomfortable to wear for extended periods. Some athletes weigh the risk of injury against the discomfort and decide that the likelihood of getting hit in the groin is low enough to forgo the protection. This is especially true in sports like football, where players often believe their padded pants and protective stances provide enough coverage, or in soccer, where only goalkeepers may feel the need for extra protection.

A protective cup for use in various physical activities is disclosed. A protective cup that enhances protection and comfort of wearing. In some embodiments, the protective cup includes various components and features that provide the added protection and comfortability. Such components may allow for the protective cup to be acutely adept at being hard enough on impact but soft enough when no impact is occurring to make an athlete more like to wear embodiments of the protective cup than a traditional cup.

Various embodiments are shown and described herein and depict variations that help in understanding the full scope of this disclosure. The protective cup may include various materials which are described more fully herein.

SUMMARY

The subject matter of the present application has been developed in response to the present state of the art, and in particular, in response to the problems and disadvantages associated with conventional systems that have not yet been fully solved by currently available techniques. Accordingly, the subject matter of the present application has been developed to provide embodiments of a protective cup apparatus and method or use that overcome at least some of the shortcomings of prior art techniques.

Disclosed herein is a protective cup apparatus. The protective cup apparatus includes a base frame including a curved and contoured shell shape with a perimeter edge, the base frame including a first material. The protective cup apparatus further includes a padded lip coupled to and around the perimeter edge of the base frame, wherein the padded lip includes a second material, and wherein the second material has a lower hardness than the first material. The protective cup apparatus includes at least one pad coupled to a front face of the base frame, wherein the pad is comprised of a viscoelastic material, and wherein the pad extends past an outermost front surface of the base frame. The preceding subject matter of this paragraph characterizes example 1 of the present disclosure.

The at least one pad comprises a plurality of pads. The preceding subject matter of this paragraph characterizes example 2 of the present disclosure, wherein example 2 also includes the subject matter according to example 1, above.

Each of the plurality of pads extends past the outermost front surface of the base frame, and wherein each of the plurality of pads comprises a shear-thickening material. The preceding subject matter of this paragraph characterizes example 3 of the present disclosure, wherein example 3 also includes the subject matter according to any one of examples 1-2, above.

Each of the plurality of pads comprises D3O®. The preceding subject matter of this paragraph characterizes example 4 of the present disclosure, wherein example 4 also includes the subject matter according to any one of examples 1-3, above.

The base frame comprises a first orifice above the plurality of pads, and wherein the base frame further comprises a second orifice on a first side of the plurality of pads, and wherein the base frame further comprises a third orifice on a second side of the plurality of pads. The preceding subject matter of this paragraph characterizes example 5 of the present disclosure, wherein example 5 also includes the subject matter according to any one of examples 1-4, above.

The front face of the base frame includes a protruding surface around the at least one pad at a location where the at least one pad is coupled to the base frame. The preceding subject matter of this paragraph characterizes example 6 of the present disclosure, wherein example 6 also includes the subject matter according to any one of examples 1-5, above.

The at least one pad is coupled to the base frame in an indentation on the front face of the base frame. The preceding subject matter of this paragraph characterizes example 7 of the present disclosure, wherein example 7 also includes the subject matter according to any one of examples 1-6, above.

The perimeter edge of the base frame is curved such that at a top of the protective cup and at a bottom of the protective cup the perimeter edge extends further than in a middle of the protective cup. The preceding subject matter of this paragraph characterizes example 8 of the present disclosure, wherein example 8 also includes the subject matter according to any one of examples 1-7, above.

The perimeter of the padded lip is curved such that at a top of the protective cup and at a bottom of the protective cup the perimeter of the padded lip extends further than in a middle of the protective cup. The preceding subject matter of this paragraph characterizes example 9 of the present disclosure, wherein example 9 also includes the subject matter according to any one of examples 1-8, above.

The base frame further comprises a plurality of slits positioned between the at least one pad and the padded lip. The preceding subject matter of this paragraph characterizes example 10 of the present disclosure, wherein example 10 also includes the subject matter according to any one of examples 1-9, above.

The protective cup apparatus further includes four pads coupled to the front face of the base frame, wherein each of the four pads surround the outermost front surface of the base frame and extend beyond the outermost front surface of the base frame. The preceding subject matter of this paragraph characterizes example 11 of the present disclosure, wherein example 11 also includes the subject matter according to any one of examples 1-10, above.

Disclosed herein is a protective cup apparatus. The protective cup apparatus includes a base frame comprising a substantially shell shape with a front convex surface and a rear concave surface with a perimeter edge around the base frame, the base frame comprising a first material. The protective cup apparatus includes a padded lip adhered to and around the perimeter edge of the base frame, wherein the padded lip extends out from the perimeter edge. The protective cup apparatus includes at least one pad adhered to the front convex surface of the base frame, wherein the pad is comprised of a shear thickening material, and wherein the pad extends beyond an outermost front surface of the base frame. The preceding subject matter of this paragraph characterizes example 12 of the present disclosure.

The at least one pad comprises a plurality of pads. The preceding subject matter of this paragraph characterizes example 13 of the present disclosure, wherein example 13 also includes the subject matter according to example 12, above.

Each of the plurality of pads extends past the outermost front surface of the base frame, and wherein each of the plurality of pads comprises a shear-thickening material. The preceding subject matter of this paragraph characterizes example 14 of the present disclosure, wherein example 14 also includes the subject matter according to any one of examples 12-13, above.

The first material is polycarbonate and each of the plurality of pads comprises D3O®. The preceding subject matter of this paragraph characterizes example 15 of the present disclosure, wherein example 15 also includes the subject matter according to any one of examples 12-14, above.

The front face of the base frame includes a protruding surface around the at least one pad at a location where the at least one pad is coupled to the base frame. The preceding subject matter of this paragraph characterizes example 16 of the present disclosure, wherein example 16 also includes the subject matter according to any one of examples 12-15, above.

The at least one pad is coupled to the base frame in an indentation on the front face of the base frame. The preceding subject matter of this paragraph characterizes example 17 of the present disclosure, wherein example 17 also includes the subject matter according to any one of examples 12-16, above.

The base frame comprises a first orifice above the plurality of pads, and wherein the base frame further comprises a second orifice on a first side of the plurality of pads, and wherein the base frame further comprises a third orifice on a second side of the plurality of pads. The preceding subject matter of this paragraph characterizes example 18 of the present disclosure, wherein example 18 also includes the subject matter according to any one of examples 12-17, above.

The base frame further comprises a plurality of slits positioned between the at least one pad and the padded lip. The preceding subject matter of this paragraph characterizes example 19 of the present disclosure, wherein example 19 also includes the subject matter according to any one of examples 12-18, above.

The plurality of pads comprises four pads coupled to the front face of the base frame, wherein each of the four pads surround the outermost front surface of the base frame and extend beyond the outermost front surface of the base frame. The preceding subject matter of this paragraph characterizes example 20 of the present disclosure, wherein example 20 also includes the subject matter according to any one of examples 12-19, above.

DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings.

Throughout the description, similar reference numbers may be used to identify similar elements.

DETAILED DESCRIPTION

Figure 1:
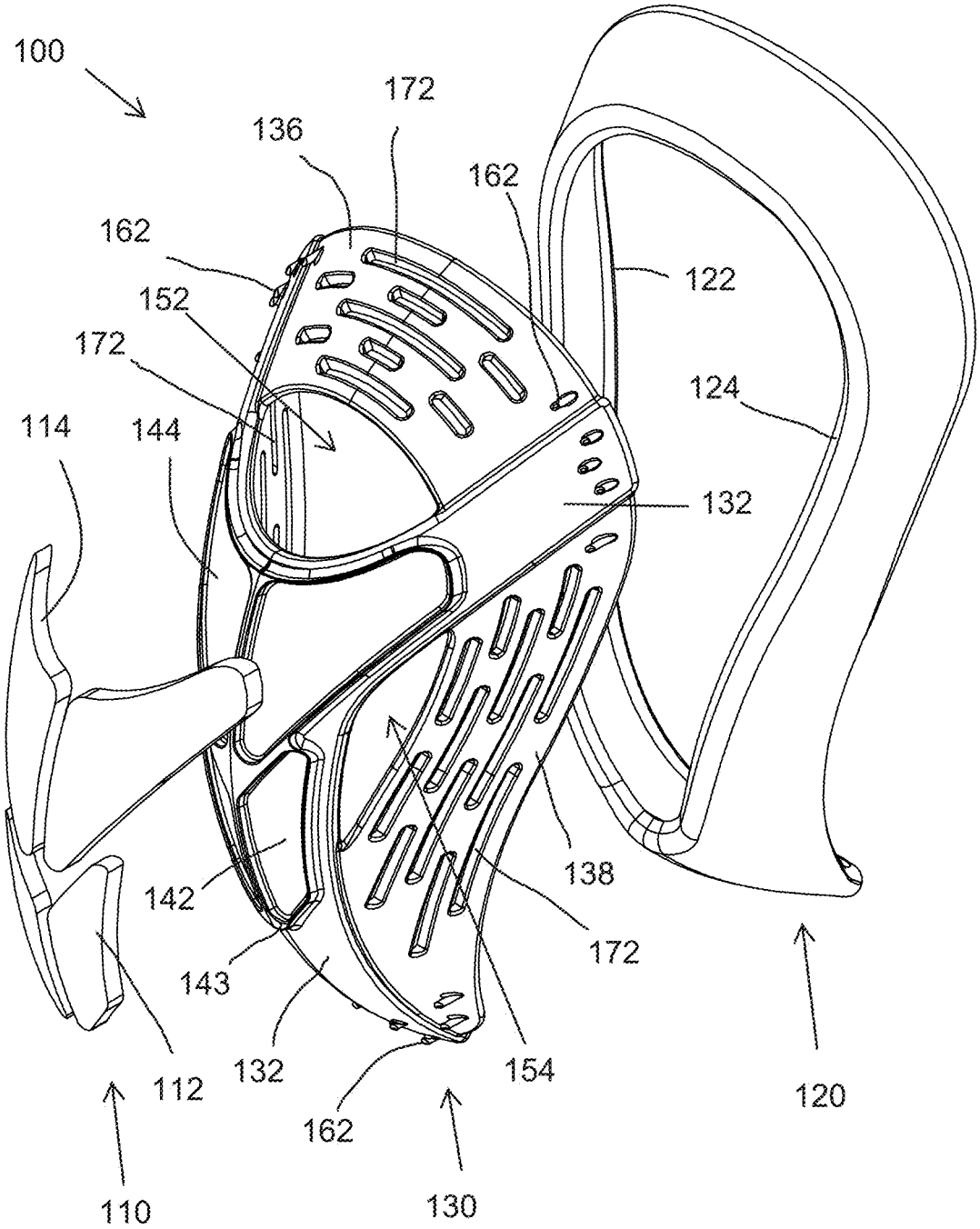
FIG. 1 depicts an exploded front perspective view of a protective cup, according to one or more embodiments of this disclosure.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

The expression "configured to" as used herein may be used interchangeably with "suitable for," "having the capacity to," "designed to," "adapted to," "made to," or "capable of" according to a context. The term "configured" does not necessarily mean "specifically designed to" in a hardware level. Instead, the expression "apparatus configured to . . . " may mean that the apparatus is "capable of . . . " along with other devices or parts in a certain context.

The terms "part", "component", "device", or "item" may be used interchangeably.

While many embodiments are described herein, at least some of the described embodiments allow for a protective cup with various components made from a non-Newtonian material. A non-Newtonian material is a substance whose viscosity, or resistance to flow, changes when force or stress is applied. Unlike Newtonian fluids, such as water or oil, which maintain a constant viscosity regardless of force, non-Newtonian materials can become more solid-like or more liquid-like depending on the applied force. These materials can be classified into different types based on their behavior. Shear-thickening (dilatant) materials increase in viscosity when force is applied. Some embodiments described herein provide comfort of wear while in use but provide more protection upon impact.

Some embodiments utilize D3O® as a material for certain components of the protective cup. D3O® is a proprietary smart material known for its impact protection and shock absorption capabilities. It is a non-Newtonian material, meaning it behaves like a soft, flexible gel under normal conditions but instantly stiffens upon impact to dissipate energy and protect against shocks.

Disclosed herein is a protective cup apparatus. In some embodiments, the protective cup apparatus includes a base frame comprising a curved and contoured shell shape with a perimeter edge, the base frame comprising a first material. In some embodiments, the protective cup apparatus includes a padded lip coupled to and around the perimeter edge of the base frame, wherein the padded lip comprises a second material, and wherein the second material has a lower hardness than the first material. In some embodiments, the protective cup apparatus includes at least one pad coupled to a front face of the base frame, wherein the pad is comprised of a viscoelastic material, and wherein the pad extends past an outermost front surface of the base frame.

In some embodiments, the at least one pad comprises a plurality of pads. In some embodiments, there are two pads. In some embodiments, there are three pads. In some embodiments, there are four pads.

In some embodiments, each of the plurality of pads extends past the outermost front surface of the base frame, and wherein each of the plurality of pads comprises a shear-thickening material. That is, the plurality of pads are the outermost exposed surface on the convex surface of the protective cup apparatus. Because the pads are separated, any load or impact may be distributed to more than one pad and provide comfort and protection.

In some embodiments, the plurality of pads are made of D3O®. In some embodiments, the base frame is made of polycarbonate. In some embodiments, the padded lip is made of silicone or another rubber like material. The combination of D3O® and polycarbonate with the physical configuration shown in the figures provides an ideal impact zone and an ideal distribution of force as the materials work together and complement each other. Such embodiments are advances over traditional solutions in the field.

In some embodiments, the base frame comprises a first orifice above the plurality of pads, and wherein the base frame further comprises a second orifice on a first side of the plurality of pads, and wherein the base frame further comprises a third orifice on a second side of the plurality of pads.

In some embodiments, the front face of the base frame includes a protruding surface around the at least one pad at a location where the at least one pad is coupled to the base frame.

In some embodiments, the at least one pad is coupled to the base frame in an indentation on the front face of the base frame.

In some embodiments, the perimeter edge of the base frame is curved such that at a top of the protective cup and at a bottom of the protective cup the perimeter edge extends further than in a middle of the protective cup.

In some embodiments, a perimeter of the padded lip is curved such that at a top of the protective cup and at a bottom of the protective cup the perimeter of the padded lip extends further than in a middle of the protective cup.

In some embodiments, the base frame further comprises a plurality of slits positioned between the at least one pad and the padded lip.

In some embodiments, the protective cup apparatus further includes four pads coupled to the front face of the base frame, wherein each of the four pads surround the outermost front surface of the base frame and extend beyond the outermost front surface of the base frame.

In some embodiments, the protective cup apparatus includes a base frame comprising a substantially shell shape with a front convex surface and a rear concave surface with a perimeter edge around the base frame, the base frame comprising a first material. In some embodiments, the protective cup apparatus includes a padded lip adhered to and around the perimeter edge of the base frame, wherein the padded lip extends out from the perimeter edge. In some embodiments, the protective cup apparatus includes at least one pad adhered to the front convex surface of the base frame, wherein the pad is comprised of a shear thickening material, and wherein the pad extends beyond an outermost front surface of the base frame.

In some embodiments, the at least one pad comprises a plurality of pads.

In some embodiments, each of the plurality of pads extends past the outermost front surface of the base frame, and wherein each of the plurality of pads comprises a shear-thickening material.

In some embodiments, the first material is polycarbonate.

In some embodiments, the front face of the base frame includes a protruding surface around the at least one pad at a location where the at least one pad is coupled to the base frame.

In some embodiments, the at least one pad is coupled to the base frame in an indentation on the front face of the base frame.

In some embodiments, the base frame comprises a first orifice above the plurality of pads, and wherein the base frame further comprises a second orifice on a first side of the plurality of pads, and wherein the base frame further comprises a third orifice on a second side of the plurality of pads.

In some embodiments, the base frame further comprises a plurality of slits positioned between the at least one pad and the padded lip.

In some embodiments, the plurality of pads comprises four pads coupled to the front face of the base frame, wherein each of the four pads surround the outermost front surface of the base frame and extend beyond the outermost front surface of the base frame.

Various Figures and Drawings are shown to give an idea to the scope of the embodiments of the invention. These figures are not meant to be limiting but illustrative to one skilled in the art.

FIG. 1 depicts an exploded front perspective view of a protective cup, according to one or more embodiments of this disclosure. The protective cup apparatus includes pads 110, a base frame 130, and a padded lip 120. Although the protective cup 100 is shown and described with certain components and functionality, other embodiments of the protective cup 100 may include fewer or more components to implement less or more functionality. This is applicable to each Figure below as well. Each individual component may include fewer or more subcomponents or features to implement less or more functionality. The descriptions are merely illustrative.

In the illustrated embodiment, the protective cup apparatus 100 is shown in an exploded view without the various components coupled to each other or adhered to each other. The protective cup apparatus 100 includes a base frame 130. The base frame 130 is a curved and contoured shell shape that forms as the spine of the protective cup apparatus 100. The base frame 130 has a generally convex surface (visible in this Figure) and a concave surface (visible in rear views shown in FIGS. 4, 5, and 7).

The base frame 130 is a solid construction that supports and gives the protective cup apparatus 100 its shape and size. The base frame 130 includes a rib 132 with a span 136 and span 138. The rib 132 is generally a y-shape with two branches of the rib terminating at a top end of the protective cup 190 and a single branch of the rib terminating at a bottom end of the protective cup 180. Spanning between the branches of the rib 132 is a span 136 and a span 138. The span 136 runs from the two upper branches. There is a first and second span 138 each running from an upper branch to the lower branch of the rib 132.

In the illustrated embodiment, it can be seen that a plurality of orifices are shown between the rib 132 and the span 136 and the span 138. Below the span 136 an upper orifice 152 is shown. To the side of span 138 and rib 132 another orifice 154 is visible. These gaps allow for airflow and further aid in allowing the rib 132 to flex upon impact if needed.

In the illustrated embodiment, there is a plurality of indentations on the convex outer surface of the rib 132. There is a lower indentation 142 and an upper indentation 144 (only a single indentation 142 is visible while there are two indentations 144 visible). The indentations are surrounded by a protruding lip 143. As will be seen in subsequent Figures, the indentations are where the pads 110 are coupled or adhered to the base frame 130. The general shape of the indentations and the protruding lip 143 are of the same general shape as the pads 110.

In the illustrated embodiment, the rib 132 is generally thicker than the spans 136 & 138. As such, the rib 132 is sturdier than the spans 136 & 138 which can result in flexing of the spans 136 & 138 upon an impact event on the protective cup apparatus 100. The base frame 130 further includes a plurality of slits 172. The slits 172 are staggered and are on both the span 136 and the span 138. The slits 172 further allow for airflow and improve flexibility and overall performance of the protective cup apparatus 100.

The base frame 130 further includes a plurality of protrusions 162. The protrusions 162 are tabs or protruding knobs that allow for the padded lip 120 to couple to the base frame 130. The protrusions 162 are found on the rib 132 and the spans 136 & 138.

The base frame 130 may be manufactured in different manners. In some embodiments, the base frame 130 is molded. In some embodiments, the base frame 130 is injection molded. In some embodiments, the base frame 130 is machined. Other embodiments may be manufactured in other manners to produce a generally or substantially hard material (sometimes a hard plastic). The base frame 130 may be made of different materials. In some embodiments, the base frame 130 is a thermoset material. In some embodiments, the base frame 130 is a thermoplastic material. In some embodiments, the base frame 130 is hard plastic. Other materials are contemplated herein as the base frame 130 is generally made of a hard material to give the protective cup apparatus 100 its shape and durability.

In some embodiments, the base frame 130 is made of polycarbonate. Polycarbonate is a strong, lightweight, and impact-resistant thermoplastic polymer known for its durability, transparency, and heat resistance. Other types of thermoplastic polymers may be used. Polycarbonate in conjunction with the shear thickening materials (such as D3O®) provide a new and enhanced way of protecting a user in the manner described herein.

Also depicted in FIG. 1 is a padded lip 120. The padded lip 120 attaches to, couples to, or adheres to the base frame 130. The padded lip 120 is generally a softer material than the base frame 130. While the base frame 130 provides the overall structural integrity of the protective cup apparatus 100, the padded lip 120 is a softer and more comfortable material that is made from a different material. The padded lip 120 is coupled to and around the perimeter edge of the base frame 130. The padded lip 120 extends farther than the base frame 130. The padded lip 120, when adhered to or coupled to the base frame 130, will cover the perimeter edge of the base frame 130 and will cover the protrusions 162 (as can be seen in the other Figures). The padded lip 120 will cover both the front face of the perimeter edge (see FIGS. 2 and 3) and the back face of the perimeter edge (see FIGS. 4 and 5). The padded lip 120 generally includes an outer perimeter edge 122 and an inner edge 124 and takes the same general curvature as the perimeter edge of the base frame 130.

Also depicted in FIG. 1 are the pads 110. The pads 110 include generally a first and second pad 114 and a first and second pad 112. The pads 110 can have various different shapes and thicknesses but are generally pad that will be seated in the indentations of base frame 130 and will extend past the protruding lip 143. The pads 110 are meant to be the outermost surface of the front face of the protective cup apparatus 100. The pads 110 are further positioned such that most impacts to the protective cup apparatus 100 will strike the pads 110. In some embodiments, there is a single pad but other embodiments such as the illustrated embodiment will have a plurality of pads 110. The illustrated embodiment shows four pads 110. With the use of a plurality of pads 110, the protective cup apparatus 100 provides a better ability to absorb impacts.

The material considerations of the pads 110 are of importance to embodiments of the invention. The pads 110 are made of advanced materials that are better able to protect a user while still being comfortable for use. In some embodiments, the pads 110 are made of a non-Newtonian material. A non-Newtonian material is a substance whose viscosity, or resistance to flow, changes when force or stress is applied. Unlike Newtonian fluids, such as water or oil, which maintain a constant viscosity regardless of force, non-Newtonian materials can become thicker (more solid-like) or thinner (more liquid-like) depending on the applied force. The material of the pads 110 may be more generally called a viscoelastic material or more specifically a shear-thickening material.

In many embodiments, the pads 110 are made of D3O®. D3O® is a proprietary smart material known for its impact protection and shock absorption capabilities. It is a non-Newtonian material, meaning it behaves like a soft, flexible gel under normal conditions but instantly stiffens upon impact to dissipate energy and protect against shocks. The combination of a material such as D3O® in the pads 110 and polycarbonate in the base frame 130 along with the physical features shown in the figures has shown a better ability to protect from impacts while also being comfortable to wear. Keeping the comfort makes it more likely that a user won't go without protection just for the sake of comfort. The use of extra pads in this type of configuration and made of a non-Newtonian fluid is an advancement over traditional cups.

Figure 2:
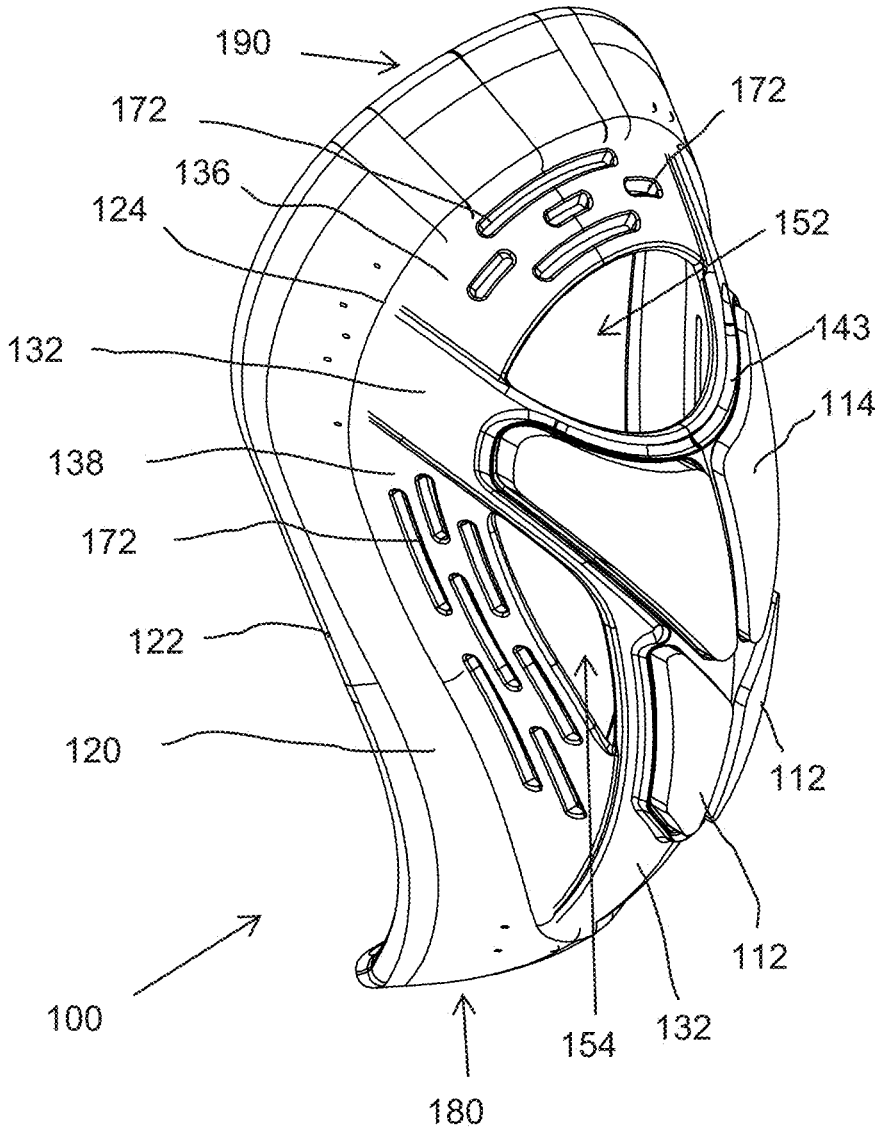
FIG. 2 depicts a front top perspective view of the protective cup of FIG. 1, according to one or more embodiments of this disclosure.

Referring now to FIG. 2, a front top perspective view of the protective cup of FIG. 1 is shown from the other side, according to one or more embodiments of this disclosure. Although the protective cup 100 is shown and described with certain components and functionality, other embodiments of the protective cup 100 may include fewer or more components to implement less or more functionality.

Many of the features previously described are better shown in this depiction. As can be seen the padded lip 120 is now coupled to or adhered to the base frame 130. The padded lip 120 forms an outer perimeter edge 122 and there is an inner edge 124 as well. To better describe the protective cup apparatus 100, it is noted on FIG. 2, the general top and bottom of the protective cup apparatus 100. The top end of the protective cup 190 and bottom end of the protective cup 180 are indicated. As can be seen, the padded lip 120 is now covering the protrusions 162. The various orifices and slits are still visible and can be seen in the figure. It is noted, however, that some of the slits 172 seen previously in FIG. 1 are now covered by the padded lip 120.

Additionally, the pads 110 have been coupled to or adhered to the base frame 130. As can be seen, the pad 114 has been positioned into the indentation 144 with a protruding lip 143 surrounding the pad 114. Further, the pad 112 has been positioned into the indentation 142 with a protruding lip 143 surrounding the pad 112. The pads 110 extend out from the outermost surface of the base frame 130.

Figure 3:
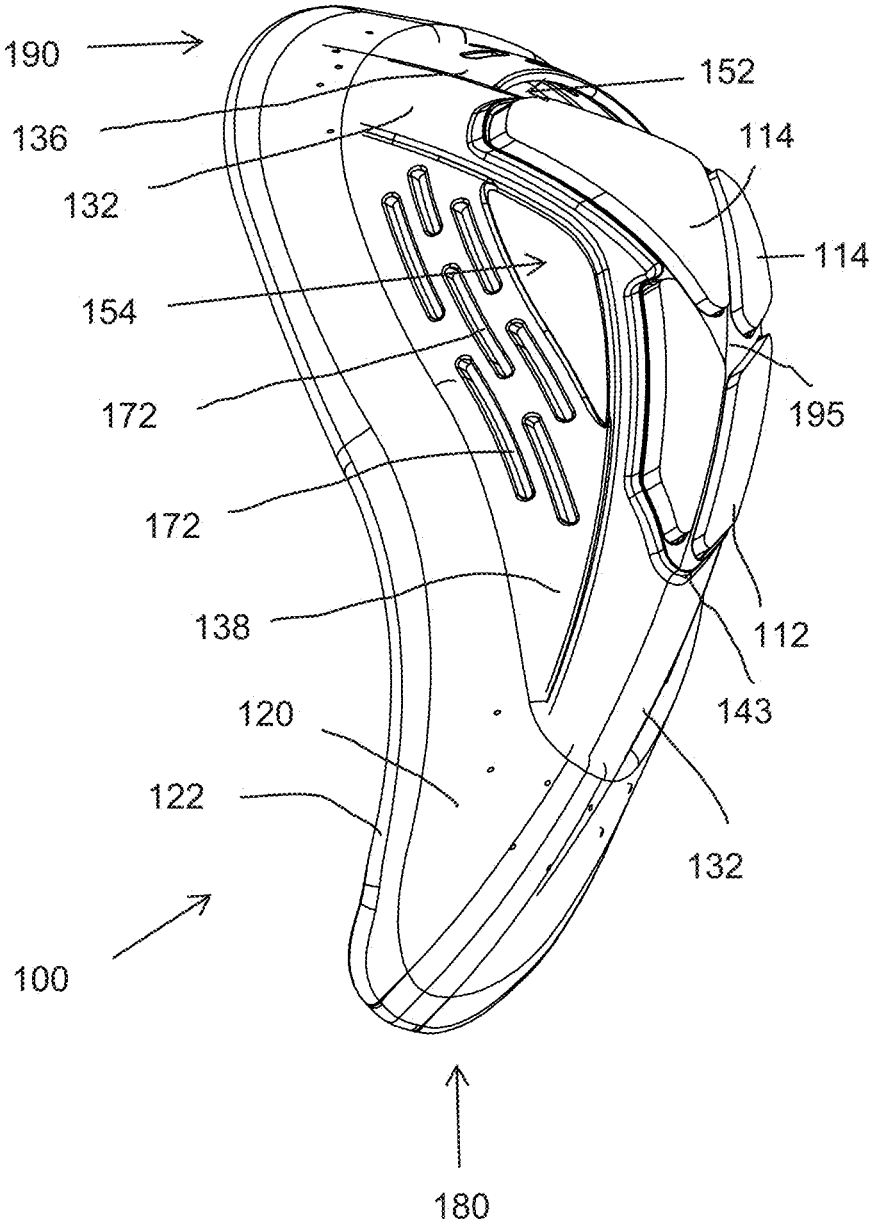
FIG. 3 depicts a front bottom perspective view of the protective cup of FIGS. 1 and 2, according to one or more embodiments of this disclosure.

FIG. 3 depicts a front bottom perspective view of the protective cup of FIGS. 1 and 2, according to one or more embodiments of this disclosure. Although the protective cup 100 is shown and described with certain components and functionality, other embodiments of the protective cup 100 may include fewer or more components to implement less or more functionality. This figure shows a different perspective view to better show some of the features already described herein.

Figure 4:
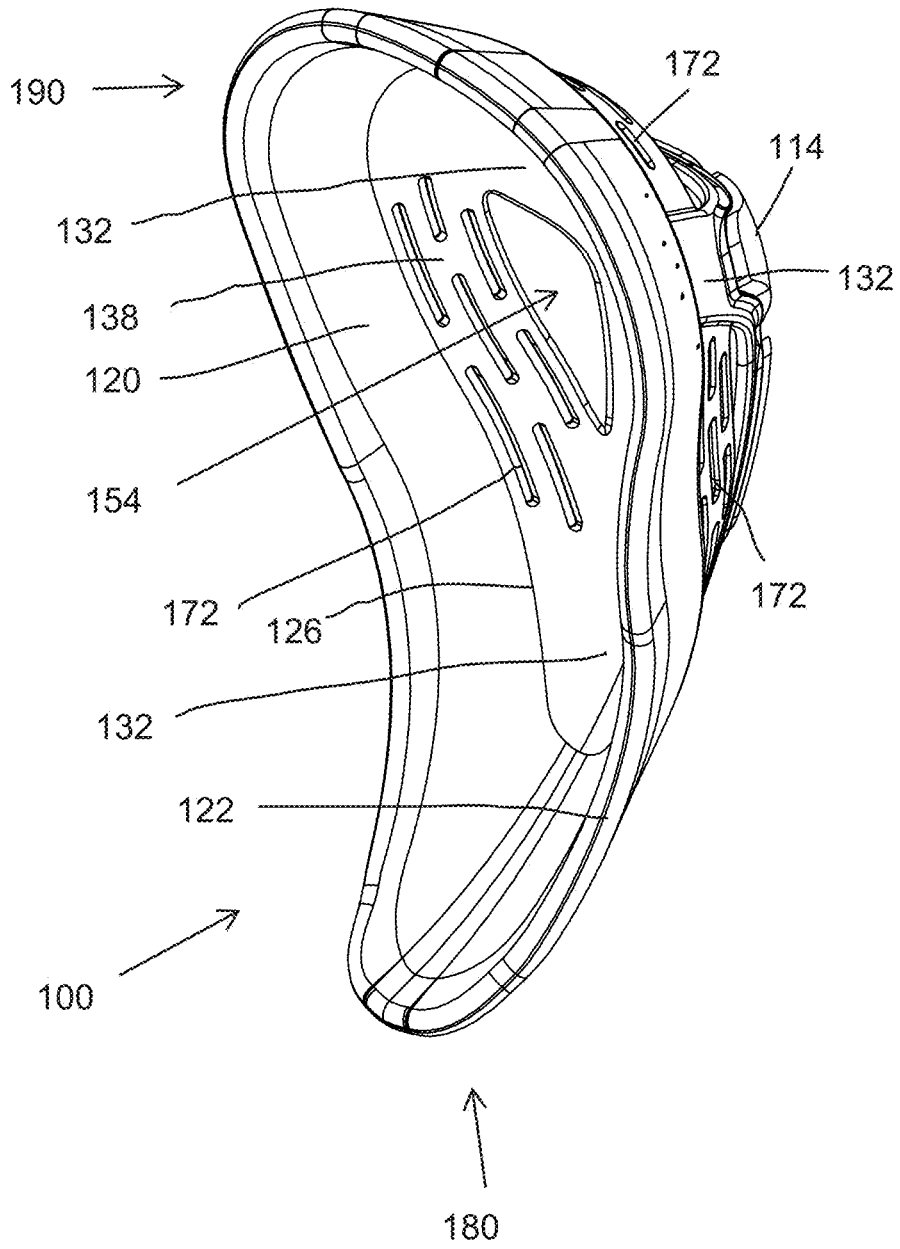
FIG. 4 depicts a rear top perspective view of a protective cup, according to one or more embodiments of this disclosure.

FIG. 4 depicts a rear perspective view of a protective cup, according to one or more embodiments of this disclosure. The rear view now shows a concave surface of the base frame 130. Of note, it can be seen that the transition from the rib 132 and spans 136 & 138 are smooth on the rear side (also back side or inner side) of the protective cup apparatus 100. The raised thickness of the rib 132 that was visible on the front of the base frame 130 is not visible on the rear side. This allows for comfort but may blur the transition on the rear side.

As can be seen, the padded lip 120 covers the perimeter edge of the base frame 130. The padded lip 120 extends to an inner edge 126. The inner edge 124 and inner edge 126 mirror each other on the front side and rear side of the base frame 130. That is, they both extend the same distance from the perimeter edge of the base frame 130. As previously discussed, the padded lip 120 is a more pliable material and softer material that allows for more comfortable wear of the protective cup apparatus 100. The padded lip 120 may be made of different materials. In some embodiments, the padded lip 120 is made of the same material as the pads 110. In other embodiments, the padded lip 120 is made of a rubber or rubber like material. In some embodiments, the padded lip 120 is made of silicone. The combination of a silicone padded lip 120, non-Newtonian material pads 110, and polycarbonate base frame 130 allows for a spread of durability and comfort that is an advancement over traditional cups.

Figure 5:
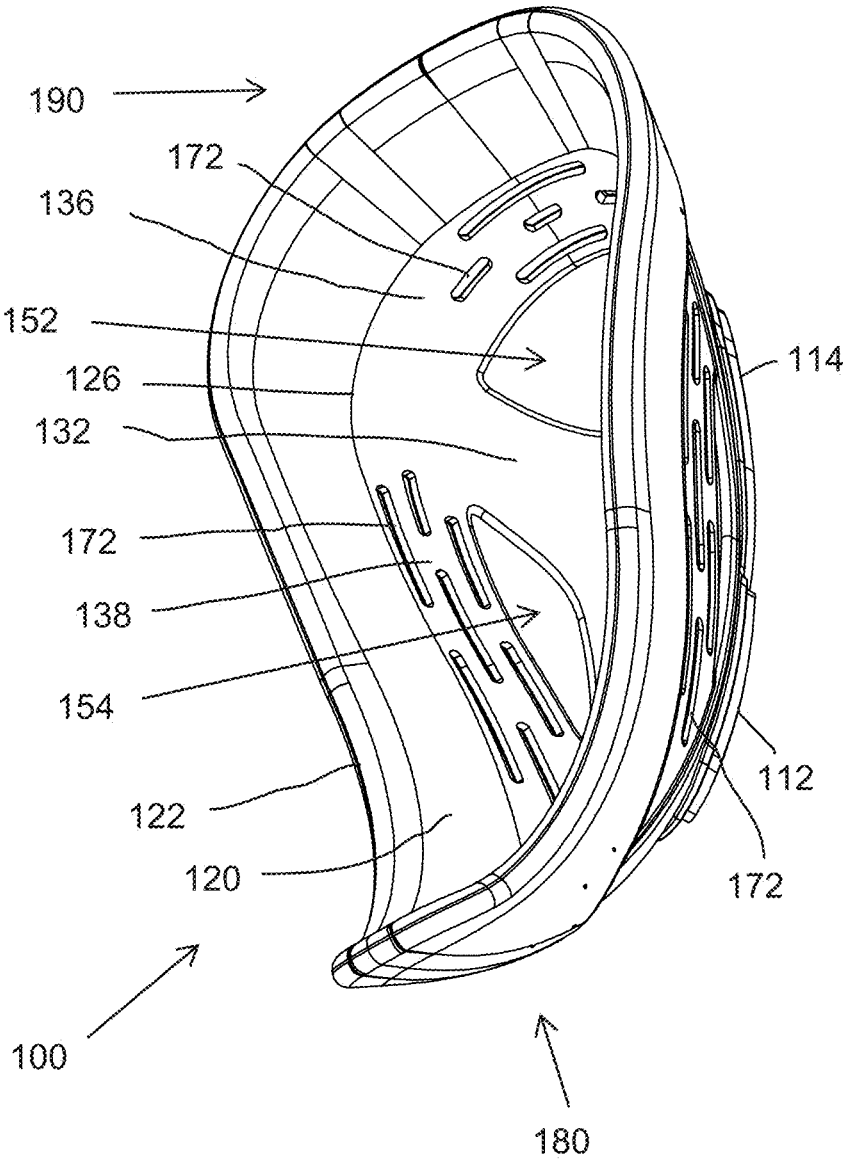
FIG. 5 depicts a rear bottom perspective view of a protective cup, according to one or more embodiments of this disclosure.

FIG. 5 depicts a rear bottom perspective view of a protective cup, according to one or more embodiments of this disclosure. Although the protective cup 100 is shown and described with certain components and functionality, other embodiments of the protective cup 100 may include fewer or more components to implement less or more functionality. This rear view further shows and depicts the various features that have already been discussed.

Figure 6:
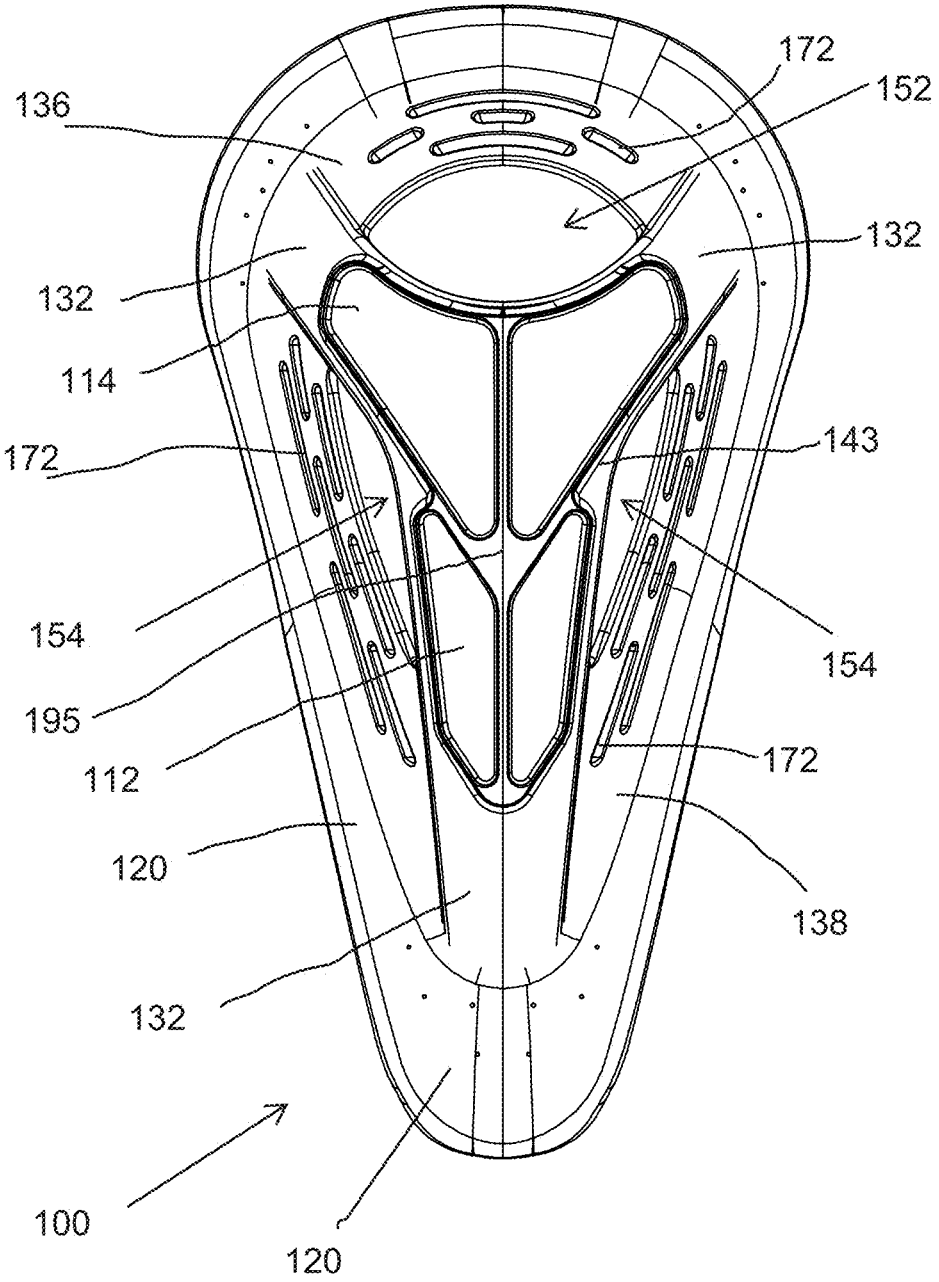
FIG. 6 depicts a front view of a protective cup, according to one or more embodiments of this disclosure.

FIG. 6 depicts a front view of a protective cup, according to one or more embodiments of this disclosure. Although the protective cup 100 is shown and described with certain components and functionality, other embodiments of the protective cup 100 may include fewer or more components to implement less or more functionality. The front view also shows many of the features already described herein. Of note, however, is the marking of the 195, which is the outermost surface of the base frame 130.

Figure 7:
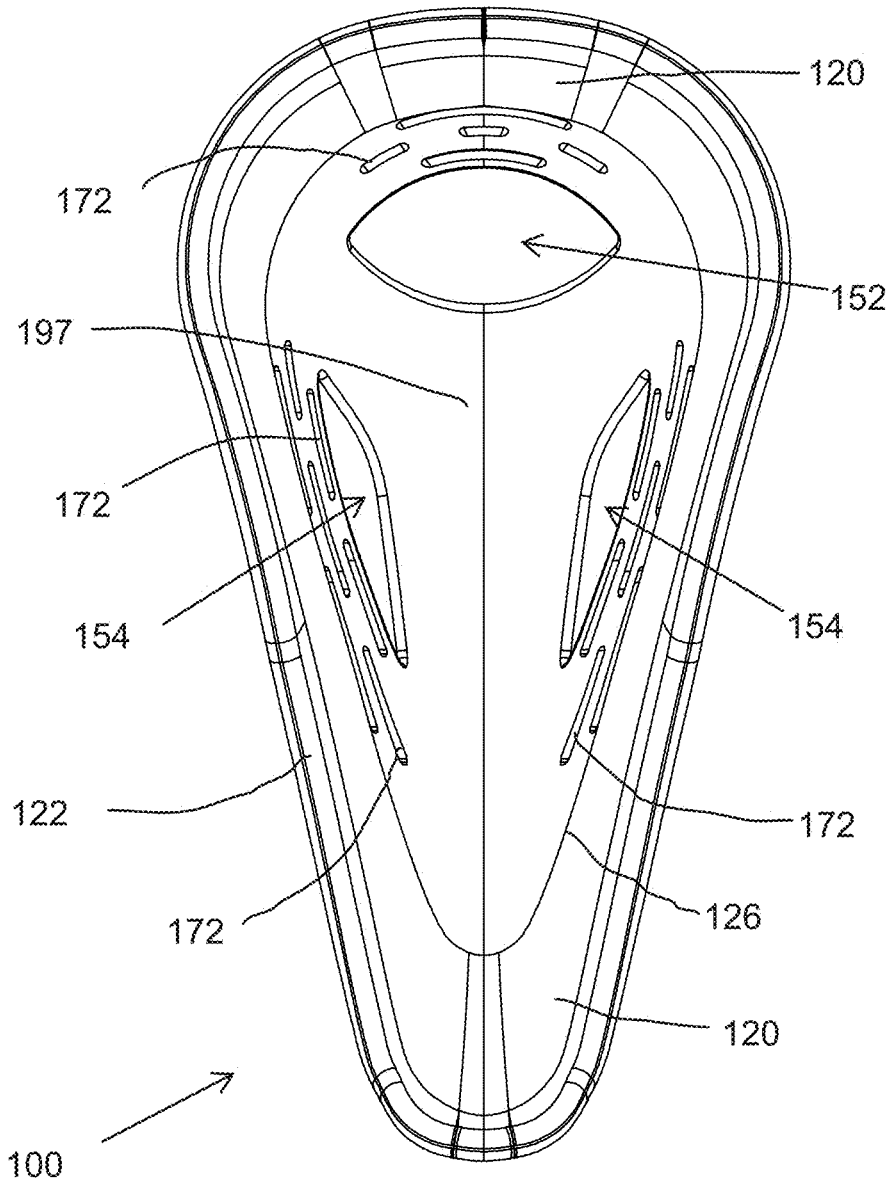
FIG. 7 depicts a rear view of a protective cup, according to one or more embodiments of this disclosure.

FIG. 7 depicts a rear view of a protective cup, according to one or more embodiments of this disclosure. Although the protective cup 100 is shown and described with certain components and functionality, other embodiments of the protective cup 100 may include fewer or more components to implement less or more functionality. This rear view is noted showing the concave surface 197 of the base frame 130. Although not shown, in some embodiments, there are additional pads 110 that are adhered to or coupled to this inside concave surface 197 so that there are pads on the front side and the rear side of the base frame 130.

Figure 8:
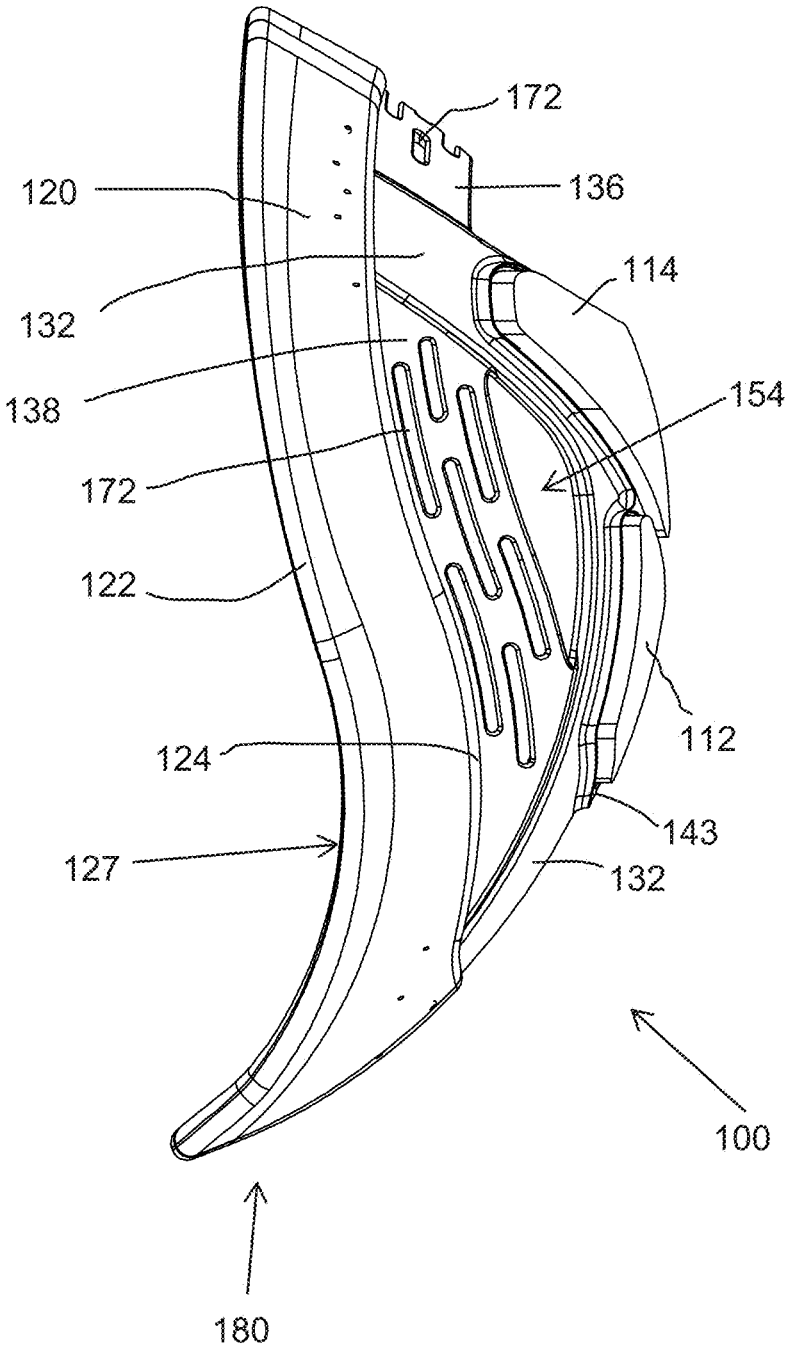
FIG. 8 depicts a side view of a protective cup, according to one or more embodiments of this disclosure.
Figure 9:
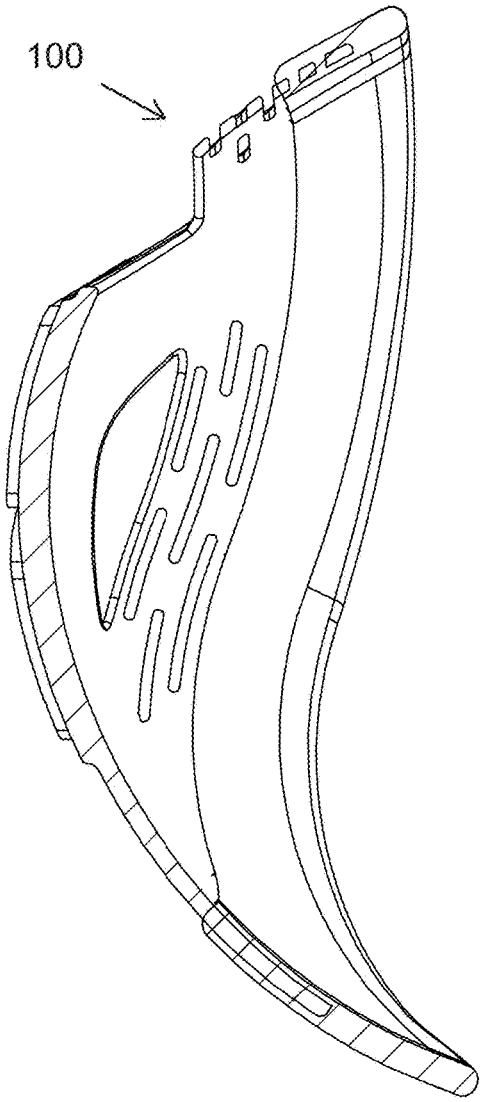
FIG. 9 depicts a side cutaway view of a protective cup, according to one or more embodiments of this disclosure.
Figure 10:
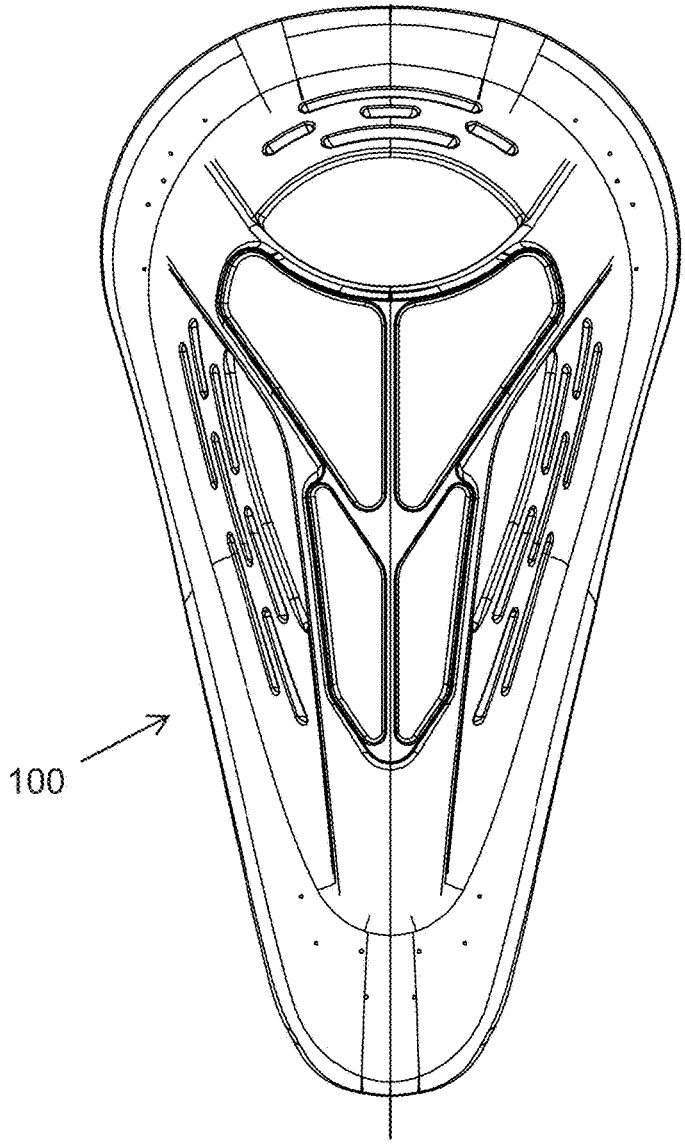
FIG. 10 depicts a front view of the protective cup, according to one or more embodiments of this disclosure.

FIG. 8 depicts a side view of a protective cup, according to one or more embodiments of this disclosure. FIG. 8 is provided to better show the features already discussed herein. FIG. 9 depicts a side cutaway view of a protective cup, according to one or more embodiments of this disclosure. FIG. 10 depicts a front view of the protective cup, according to one or more embodiments of this disclosure. Although the protective cup 100 is shown and described with certain components and functionality, other embodiments of the protective cup 100 may include fewer or more components to implement less or more functionality. These views are also shown to better understand the features already shown and described. Of note, from FIG. 9, the thicker cross section of the rib 132 is shown relative to the span 136.

Figure 11:
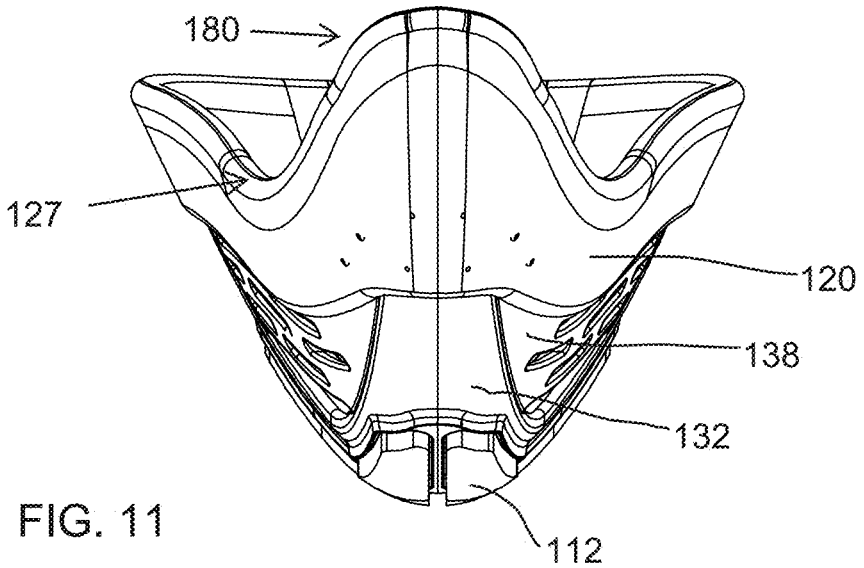
FIG. 11 depicts a bottom view of a protective, according to one or more embodiments of this disclosure.
Figure 12:
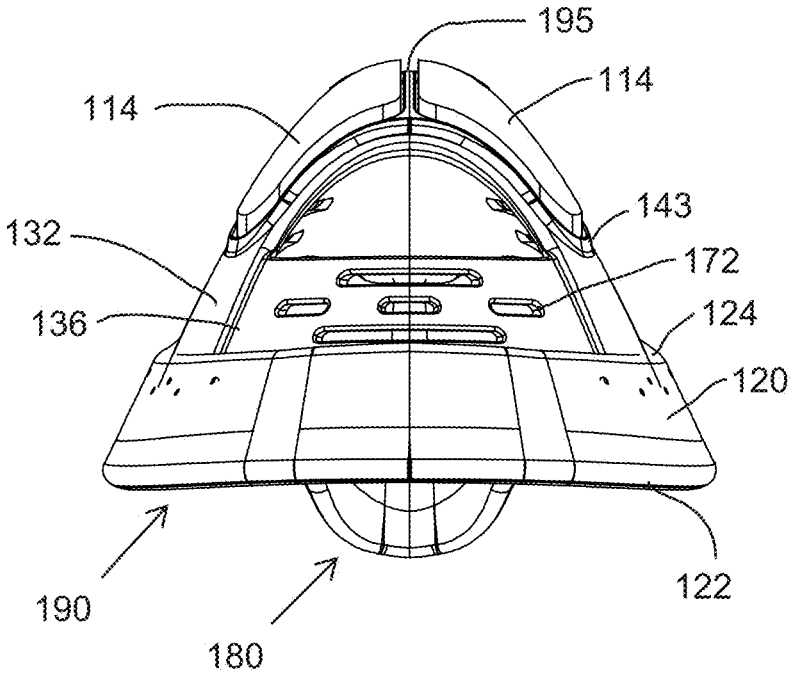
FIG. 12 depicts a top view of the protective cup, according to one or more embodiments of this disclosure.

FIG. 11 depicts a bottom view of a protective, according to one or more embodiments of this disclosure. FIG. 12 depicts a top view of the protective cup, according to one or more embodiments of this disclosure. Although the protective cup 100 is shown and described with certain components and functionality, other embodiments of the protective cup 100 may include fewer or more components to implement less or more functionality. These different views are shown to depict the features already described herein. Of note, the contour of the outer perimeter edge 122 is better seen in FIG. 11 and shows 127 (see also FIG. 8). In some embodiments, the perimeter edge of the base frame is curved such that at a top of the protective cup and at a bottom of the protective cup the perimeter edge extends further than in a middle of the protective cup (see 127).

Although specific embodiments of the invention have been described and illustrated, the invention is not to be limited to the specific forms or arrangements of parts so described and illustrated. The scope of the invention is to be defined by the claims appended hereto and their equivalents.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Although the operations of the method(s) or processes herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A protective cup apparatus, the protective cup apparatus comprising:

a base frame comprising a curved and contoured shell shape with a perimeter edge surrounding a front convex surface, the base frame comprising a first material;

a padded lip coupled to and around the perimeter edge of the base frame, wherein the padded lip comprises a second material, and wherein the second material has a lower hardness than the first material; and at least one pad coupled to a front face of the base frame, wherein the at least one pad is comprised of a viscoelastic material, and wherein the at least one pad is raised above the front convex surface of the base frame, wherein the front convex surface is the outermost surface of the base frame.

2. The protective cup apparatus of claim 1, wherein the at least one pad comprises a plurality of pads.

3. The protective cup apparatus of claim 2, wherein each of the plurality of pads extends past the front convex surface of the base frame, and wherein each of the plurality of pads comprises a shear-thickening material.

4. The protective cup apparatus of claim 3, wherein each of the plurality of pads comprises D3O®.

5. The protective cup apparatus of claim 4, wherein the base frame comprises a first orifice above the plurality of pads, and wherein the base frame further comprises a second orifice on a first side of the plurality of pads, and wherein the base frame further comprises a third orifice on a second side of the plurality of pads.

6. The protective cup apparatus of claim 1, wherein at a location where the at least one pad is coupled to the base frame, the front face of the base frame includes a protruding surface around the at least one pad.

7. The protective cup apparatus of claim 6, wherein the at least one pad is coupled to the base frame in an indentation on the front face of the base frame.

8. The protective cup apparatus of claim 1, wherein the perimeter edge of the base frame is curved such that at a top of the protective cup and at a bottom of the protective cup the perimeter edge extends further than in a middle of the protective cup.

9. The protective cup apparatus of claim 1, wherein a perimeter of the padded lip is curved such that at a top of the protective cup and at a bottom of the protective cup the perimeter of the padded lip extends further than in a middle of the protective cup.

10. The protective cup apparatus of claim 1, wherein the base frame further comprises a plurality of slits positioned between the at least one pad and the padded lip.

11. The protective cup apparatus of claim 1, further comprising four pads coupled to the front face of the base frame, wherein each of the four pads surround the front convex surface of the base frame and extend beyond the front convex surface of the base frame.

12. A protective cup apparatus, the protective cup apparatus comprising:

a base frame comprising a substantially shell shape with a front convex surface and a rear concave surface with a perimeter edge around the base frame, the base frame comprising a first material;

a padded lip adhered to and around the perimeter edge of the base frame, wherein the padded lip extends out from the perimeter edge; and at least one pad adhered to the front convex surface of the base frame, wherein the at least one pad is comprised of a shear thickening material, and wherein the at least one pad is raised above the front convex surface of the base frame, wherein the front convex surface is the outermost surface of the base frame.

13. The protective cup apparatus of claim 12, wherein the at least one pad comprises a plurality of pads.

14. The protective cup apparatus of claim 13, wherein each of the plurality of pads extends past the front convex surface of the base frame, and wherein each of the plurality of pads comprises a shear-thickening material.

15. The protective cup apparatus of claim 14, wherein the first material is polycarbonate.

16. The protective cup apparatus of claim 15, wherein at a location where the at least one pad is coupled to the base frame, the front face of the base frame includes a protruding surface around the at least one pad.

17. The protective cup apparatus of claim 16, wherein the at least one pad is coupled to the base frame in an indentation on the front face of the base frame.

18. The protective cup apparatus of claim 17, wherein the base frame comprises a first orifice above the plurality of pads, and wherein the base frame further comprises a second orifice on a first side of the plurality of pads, and wherein the base frame further comprises a third orifice on a second side of the plurality of pads.

19. The protective cup apparatus of claim 18, wherein the base frame further comprises a plurality of slits positioned between the at least one pad and the padded lip.

20. The protective cup apparatus of claim 19, wherein the plurality of pads comprises four pads coupled to the front face of the base frame, wherein each of the four pads surround the front convex surface of the base frame and extend beyond the front convex surface of the base frame.

* * * * *